US007381140B1

(12) United States Patent
Stanisic

(10) Patent No.: US 7,381,140 B1
(45) Date of Patent: Jun. 3, 2008

(54) TENNIS TEACHING INSTRUCTIONAL AID

(76) Inventor: David Stanisic, 19501 Brookline Ave., Sonoma, CA (US) 95476

( * ) Notice: Subject to any disclaimer, the term of this patent is extended or adjusted under 35 U.S.C. 154(b) by 0 days.

(21) Appl. No.: 11/635,261

(22) Filed: Dec. 6, 2006

(51) Int. Cl.
*A63B 69/38* (2006.01)

(52) U.S. Cl. ..... 473/464

(58) Field of Classification Search ..... 473/459, 473/464, 212, 213
See application file for complete search history.

(56) References Cited

U.S. PATENT DOCUMENTS 1,655,092 A * 1/1928 Davis ..... 473/212
3,324,851 A * 6/1967 Posner ..... 128/878
3,861,688 A * 1/1975 Butler ..... 473/214
4,209,169 A * 6/1980 Roberts ..... 473/464
5,005,833 A * 4/1991 Groveman et al. ..... 473/464
5,108,103 A * 4/1992 Rilling ..... 473/213
5,295,690 A * 3/1994 Johnson ..... 473/212
5,348,292 A * 9/1994 Norman, Sr. ..... 473/438
5,746,672 A * 5/1998 Smith ..... 473/464
5,865,685 A * 2/1999 Thomas ..... 473/213
6,755,755 B2 * 6/2004 Wah Loh ..... 473/458
6,773,366 B2 * 8/2004 Gray ..... 473/458
6,863,616 B2 * 3/2005 Snyder et al. ..... 473/212
6,984,184 B2 * 1/2006 Gray ..... 473/458
7,147,581 B1 * 12/2006 Williams, III ..... 473/464

* cited by examiner

*Primary Examiner*—Raleigh W. Chiu

(57) ABSTRACT

A training device to improve tennis skills. The device includes wristbands for encircling each wrist of a user and a tension device with an umbilical attached to it and to the wristbands. The umbilical is under constant tension during use of the training device to encourage the movement of a user's hands in unison in carrying out a tennis stroke.

11 Claims, 6 Drawing Sheets

TENNIS TEACHING INSTRUCTIONAL AID

TECHNICAL FIELD

The present invention involves a training device to improve tennis skills. The device encourages a player to bring his or her hands together to encourage the player's hands to move his or her hands in unison in carrying out a tennis stroke.

BACKGROUND OF THE INVENTION

In providing instruction to tennis players for improving a player's skills, it is emphasized that not only should the hand holding the racket move to a position prepatory for stroking the ball but that the user's other hand move in the same direction thus causing a user's body to turn appropriately. This properly aligns the shoulders and increasing the effectiveness of the stroke, improving ball velocity and placement while minimizing injury. Conversely, many players, particularly novice players, move only the hand holding the racket allowing the other hand to remain idly by and giving little or no consideration to body positioning in preparing for the return of an oncoming tennis ball. In doing so, ball velocity, accuracy, consistency and pace are reduced and, perhaps more importantly, ball direction on the return stroke can be haphazard and unpredictable.

The present invention is not the first teaching of an aid to improve tennis skills by coordinating wrist movement of a user. Specifically, U.S. Pat. No. 5,005,833 teaches a device for joining a player's wrists together so as to engender movement of both arms and shoulders together in executing a tennis stroke. This patent further suggests extending, from a wristband and onto a user's middle finger a loop to prevent or reduce palmar flexion.

Although the invention described and claimed in the '833 patent is of interest in recognizing the benefits of joining a player's wrists together in executing a tennis stroke, it has been found that the components suggested for implementing this function are inadequate and do not, in the final analysis, provide the intended function. Specifically, the '833 patent suggests employing straps for joining first and second wristbands together. The buckled straps of the prior art can be changed in length through the use of buckles but once fixed, the straps represent nothing more than rigid extenders providing no tension between a user's wrists when the straps have not been pulled to their full extended length and, of equal importance, do not enable the wrists of a user to extend beyond the fixed strap length.

The straps suggested in carrying out the invention disclosed in the '833 patent are deficient for a number of reasons. Firstly, unless the straps are pulled to their full fixed length, neither wrist of the user is encouraged to move in the direction of the other. As such, when the dominant or racquet hand of a user moves, there is nothing to encourage the subservient hand to move in the same direction unless in moving the dominant hand, full strap length is established between wrists causing the subservient hand to be yanked or abruptly pulled in the direction of the racqueted hand. This is hardly a way to encourage unison wrist movement. Secondly, there are times in which the distance between the wrists of a user are to be greater than the intended spacing between wrists during tennis strokes. For example, if the training device is to be employed for all purposes both during training and in participating in an actual match, ball service, requiring an overhead stroke would undoubtedly require wrist spacing far greater than if a forehand or backhand was to be conducted using this training aid under normal circumstances. The fixed strap of the '833 patent would prevent overhead or service strokes if the strap was to be fixed at a normal spacing for forehand and backhand play.

It is thus an object of the present invention to provide a teaching aid for improving tennis skills which is devoid of the limitations of the prior art.

It is yet a further object of the present invention to provide a tennis aid tensioning and thus encouraging unison of movement between the wrists of a player to improve tennis skills.

These and further objects will be more readily apparent when considering the following disclosure and appended claims.

SUMMARY OF THE INVENTION

The present invention is directed to a training device to improve tennis skills, the training device comprising wristbands for encircling each wrist of a user, a tension device that tensions an umbilical that is attached to said wristbands, said umbilical being under constant tension during use of the training device to encourage the movement of a user's hands in unison in carrying out a tennis stroke.

DETAILED DESCRIPTION OF THE INVENTION

Figure 6:
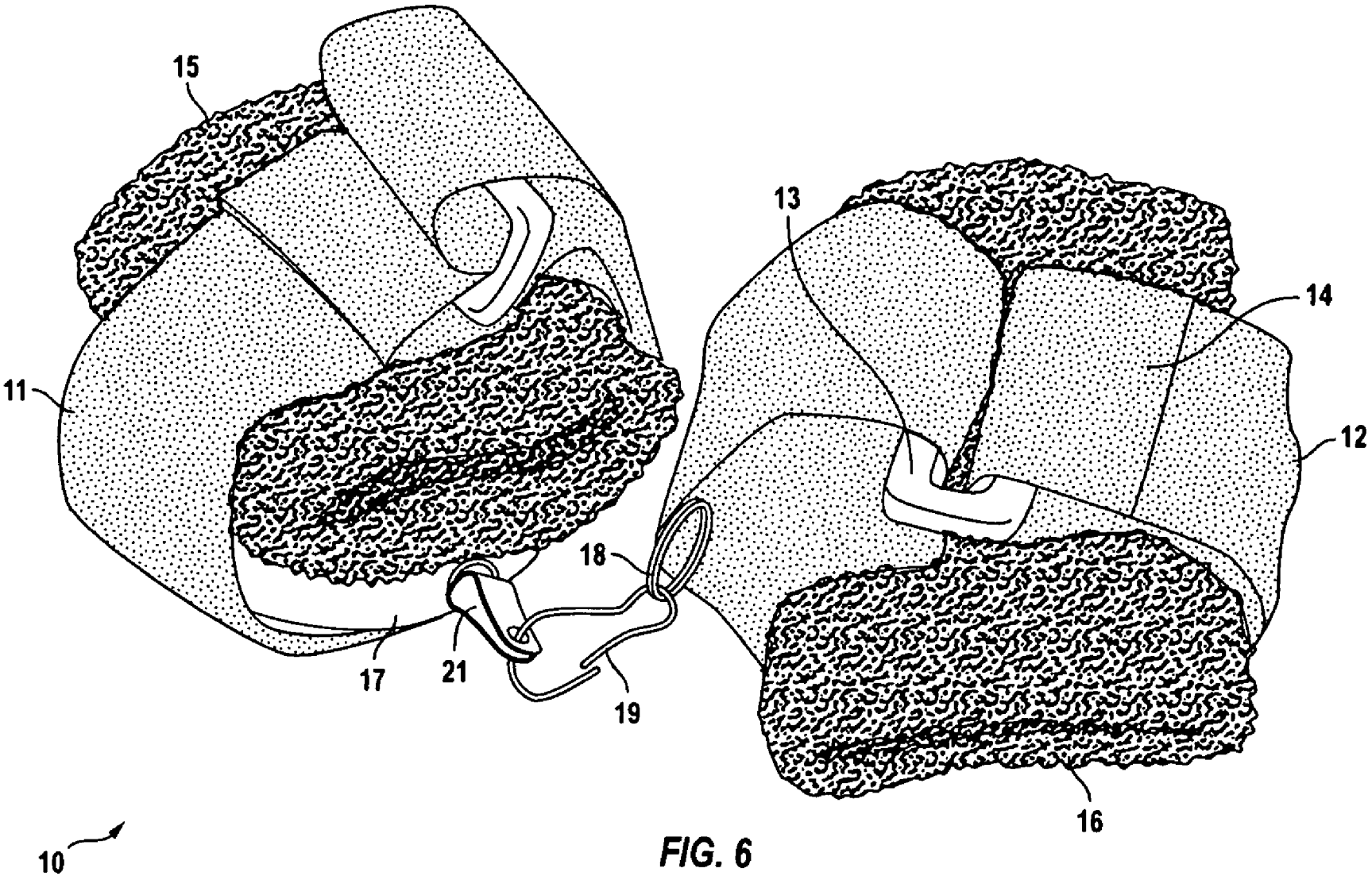
FIG. 6 is a perspective of the present invention showing its various component parts.

The component parts of the present invention can perhaps best be appreciated in making reference to FIG. 6. Training device 10 is comprised of wristbands 11/15 and 12/16 which are intended to encircle each wrist of a user. The term "wristbands" is used generally to describe the component parts which encircle a user's wrist during use. Ideally, these parts include straps 11 and 12 which can be composed of relatively durable fabric and adjustable to accommodate users of various sizes. As a preferred embodiment, straps 11 and 12 would include terminal end 14 for wrapping about buckle 13. Hook and loop fasteners or snaps would then be employed to secure terminal end 14 to the body of strap 12, again, to accommodate a user's wrist regardless of a player's physical size. Straps 11 and 12 are intended to encircle commonly employed absorbent wristbands 15 and 16. Wristbands 15 and 16 are normally used by a player in order to act as sweat absorbent members in order to prevent moisture from compromising a user's grip. However, straps 11 and 12 and absorbent wristbands 15 and 16 can be made as unitary members while remaining within the spirit and scope of the present invention.

Appended to strap 11 is constant tension device 17. Such devices are quite common as they generally contain a tension spring appended to an end of a pay out umbilical such that for the entire length of the umbilical, tension is maintained as long as there is a minimal pay out from the umbilical's rest position as shown in FIG. 6. The umbilical, contained completely within tension device 17 is terminated by umbilical clip 21 which is releasably connected to strap 14 through the use of ring holder 18 and bridging hook 19. As such, as elements 18, 19 and 21 are appended to one another. As wristband and straps 11/15 and 12/16 separate from one another, constant tension is applied encouraging a user to bring his or her wrist together regardless of the length of separation between the user's wrists.

Figure 1:
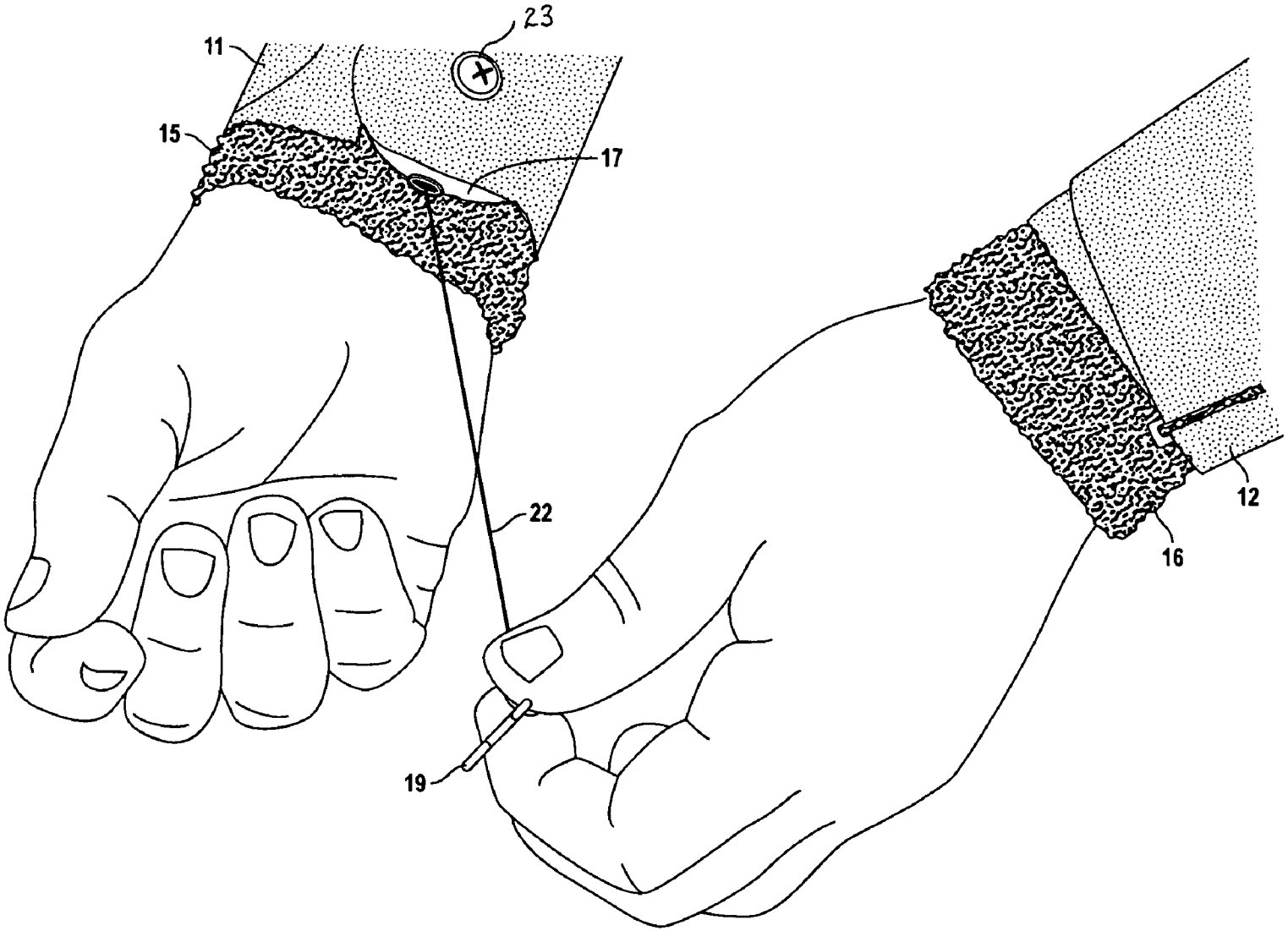
FIG. 1 is a perspective view of the hands of a user, including a user's wrists supporting the present invention as an umbilical is paid out from a first wrist for attachment to a second.

In turning to FIG. 1, the present invention 10 is shown installed on a user's wrists. Ideally, tension device 17 is shown situated on the dominant hand of a user, that is, in this instance, the right hand of a user that will be the hand holding the racquet. Tension device 17 is shown sandwiched beneath strap 11 and above absorbent wristband 15 held in position through retaining rivet 23 which extends from the body of tension device 17 through strap 11. To continue, the left hand of a user grasps bridging hook 19 thus pulling umbilical 22 from tension device 17. It is noted that, ideally, pay out of umbilical 17 is toward the fingertips of a user on the under or palm side of the user's hand.

Figure 2:
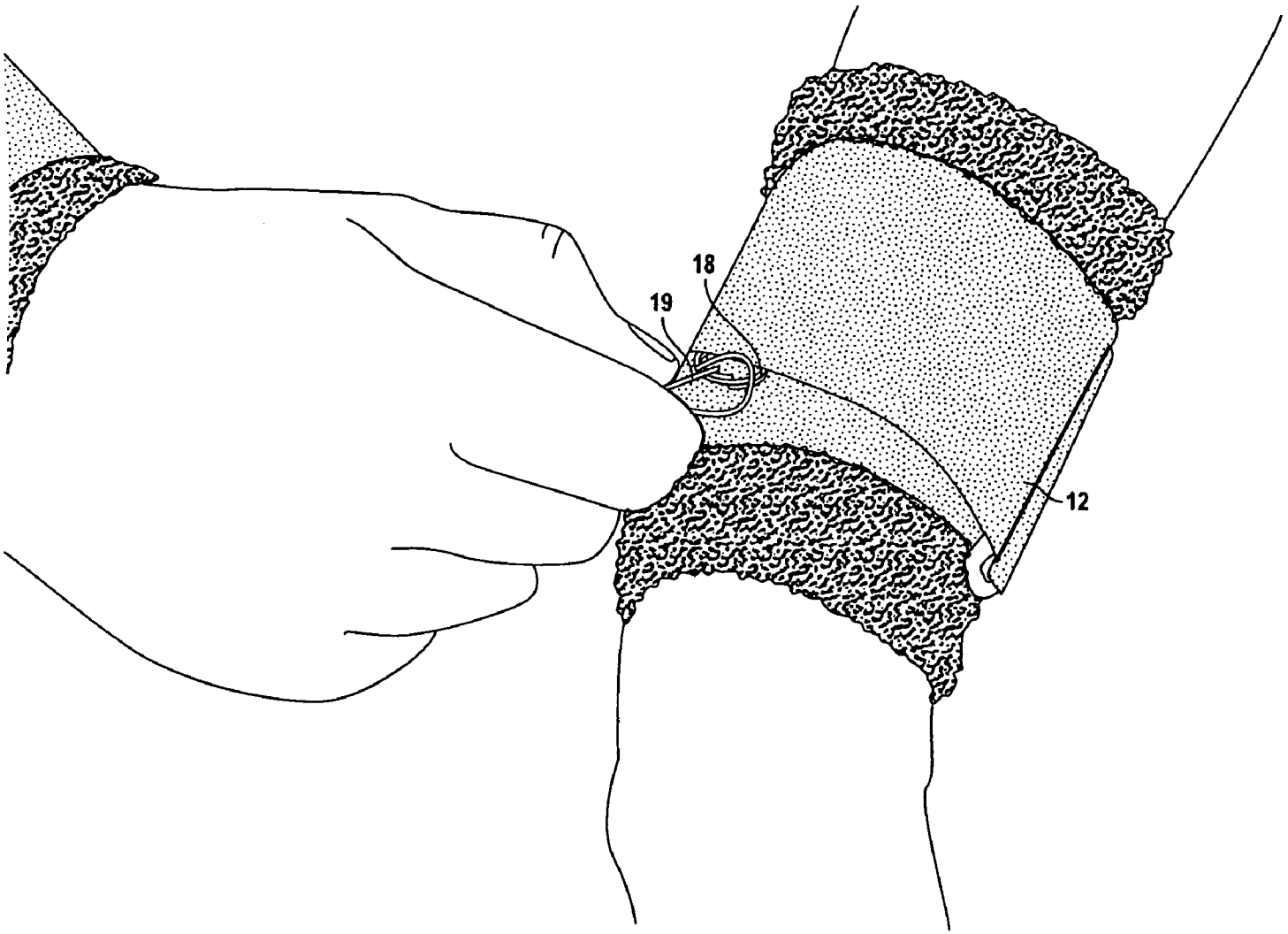
FIG. 2 is a perspective of a user's hand and wrists showing attachment of the umbilical to complete the set up of the present invention.

FIG. 2 depicts the connection of bridging hook 19 to ring holder 18 onto strap 12 of the user's non dominant, in this case left, hand. It is further seen that, in an ideal arrangement, ring holder 18 is situated on the under or palm side of the non dominant hand. In properly gripping tennis racquet 25 (FIG. 3), the attachment of the wristbands of a user through umbilical 22 is shown highlighting the desirability of having the umbilical pay out from the underside of the dominant hand and to be received by ring holder 18 on the subservient hand, again on its palm or underside surface.

Figure 3:
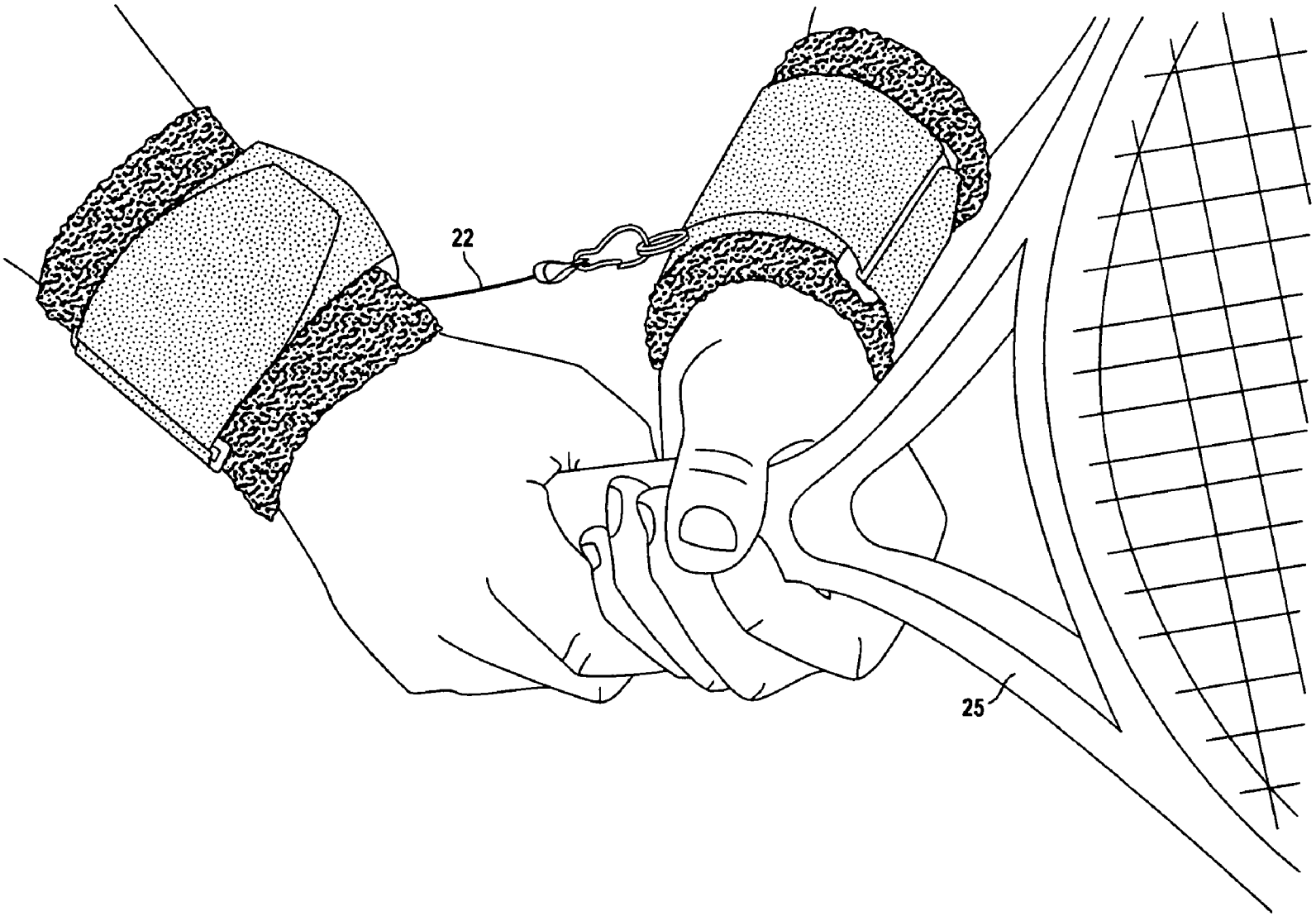
FIG. 3 is a perspective of a user's hands and wrists embodying the present invention while holding a racquet ready for play.

In further reference to FIG. 3, it can now be appreciated that when a player is in the ready position to anticipate an oncoming ball stroked by an opposing player, umbilical 22, under tension, encourages the user's hands to move together. This critical feature performs the objective of the present invention by conditioning muscle memory to bring hands close together prior to striking the ball.

Figure 4:
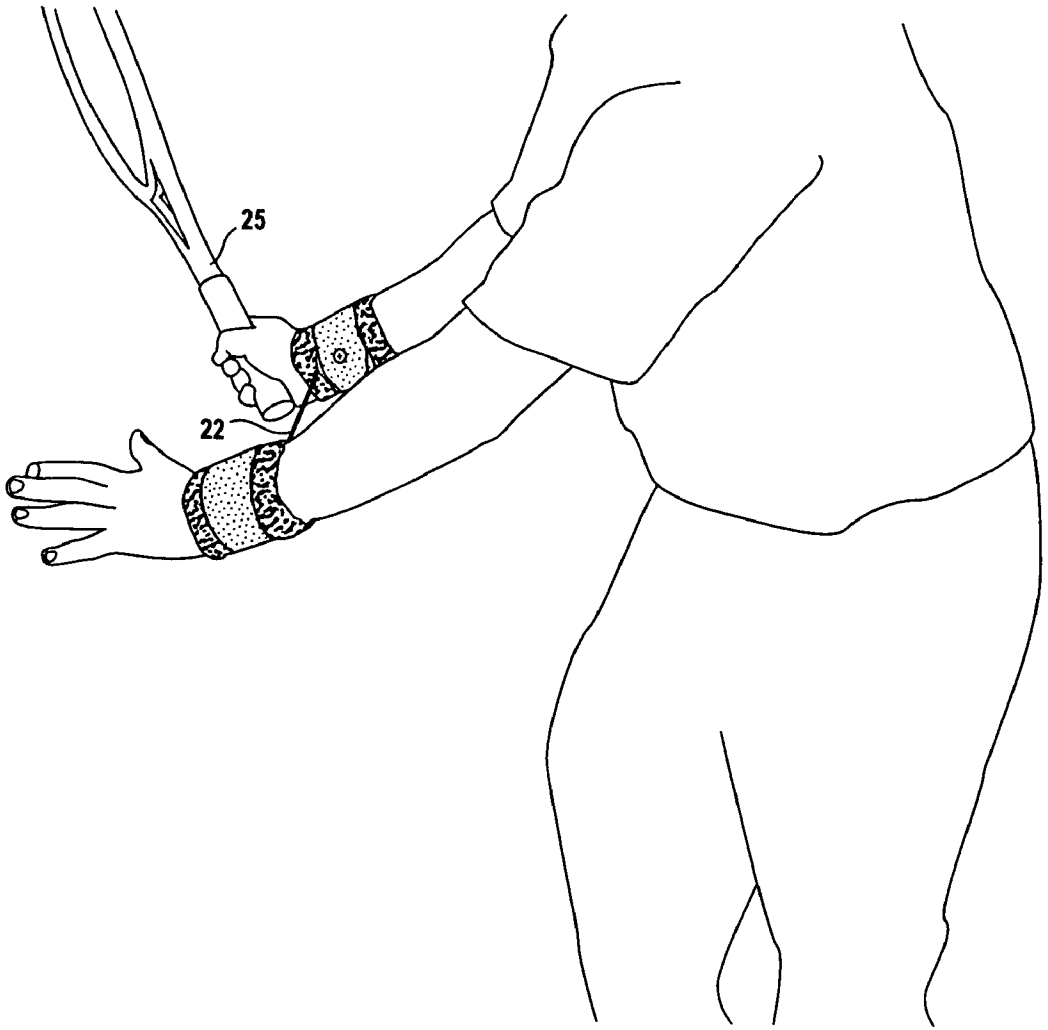
FIG. 4 shows the use of the present invention in connection with the torso, arm, wrists and hands of a user as the user prepares to engage in a forehand tennis stroke.

FIG. 4 depicts the use of the present invention in preparing for a forehand tennis stroke. Racquet 25 is held by the dominant hand connected to subservient hand by umbilical 22. As the dominant hand moves back, the non-dominant hand shadows the dominant hand following the same path thus encouraging the shoulders and upper torso of the player to rotate. This critical action is highly encouraged in creating the appropriate dynamics for a successful strike and return of the ball. Training device 10 also encourages a minimal limited and restriction take back which aides in the readiness of the player to strike the ball because the player's hands are maintained in their confined sensation of being in front of the player as well as being close together. The prior art strap made the subject of the '833 patent is incapable of creating this tensioned sensation.

Figure 5:
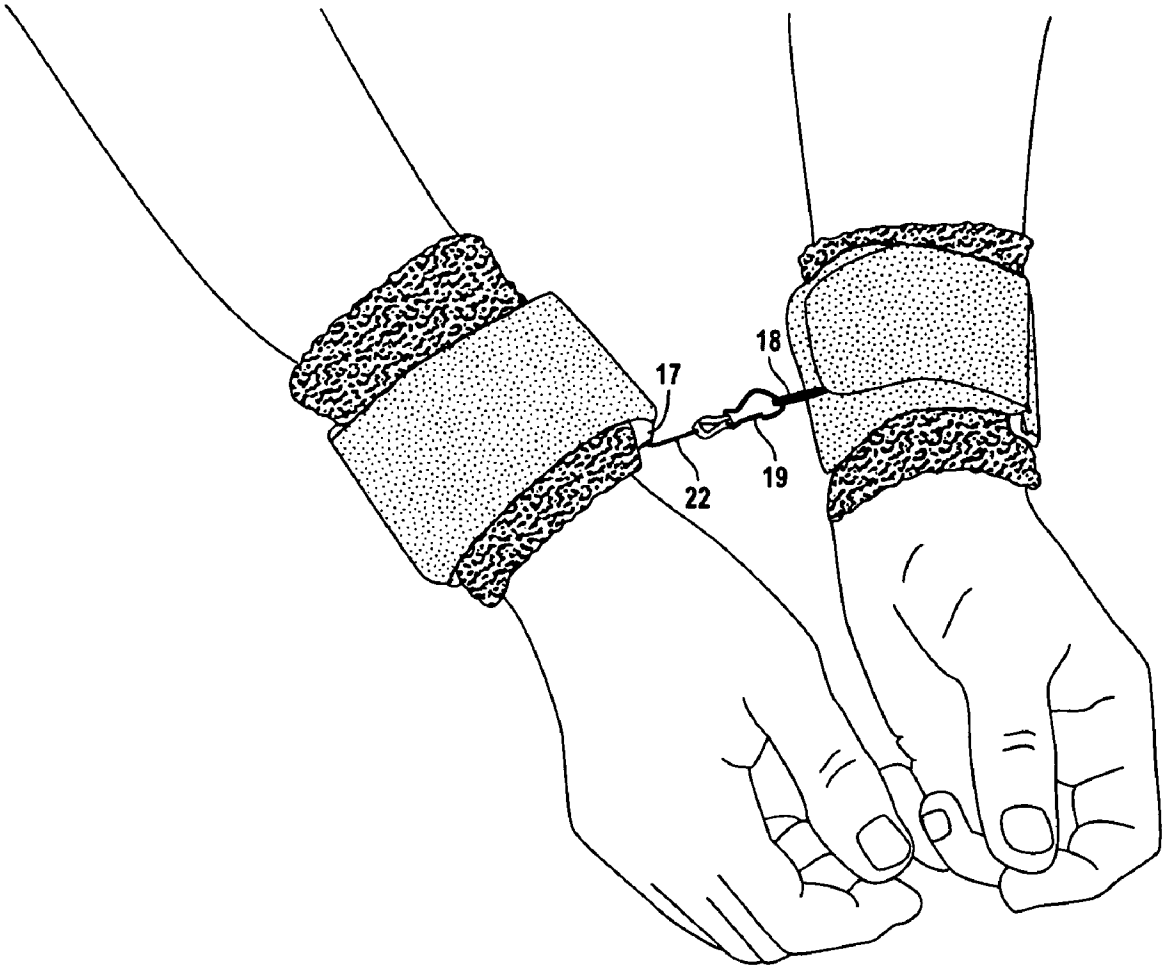
FIG. 5 shows the wrists and hands of a user in a relaxed state.

FIG. 5 depicts training device 10 while the hands of a player are in a relaxed state. However, even in this relaxed state, it is noted that umbilical 22 is slightly paid out from tension device 17 so that there is some tensioned inclination to draw the hands of the player together. This provides a player with almost a sense of gravitational-like-attraction constantly encouraging a player to move both a dominant and subservient hands in unison in order to carry out the appropriate tennis stroke. The umbilical should also be of sufficient length such that a player's wrists can be spread apart from one another their full span without the umbilical preventing such movement.

The invention claimed is:

1. A training device to improve tennis skills, said training device comprising wristbands for encircling each wrist of the user, a tension device and umbilical attached thereto and to said wristbands, said umbilical being under constant tension during use of said training device to encourage the movement of the user's hands in unison in carrying out a tennis stroke.

2. The training device of claim 1 wherein said tension device comprises a spring-loaded spool of said umbilical.

3. The training device of claim 2 wherein said tension device is attached to a first wristband and a free end of said umbilical is attached to a second wristband.

4. The training device of claim 3 wherein said wristbands comprise straps capable of looping about a user's wrists and secured thereto.

5. The training device of claim 4 wherein absorbent wristbands are positioned on each of the user's wrist prior to the application of said straps.

6. The training device of claim 5 wherein said tension device is located between said straps and said absorbent wristbands.

7. The training device of claim 6 wherein said tension device is affixed to one of said straps.

8. The training device of claim 1 wherein said umbilical is of a tensioned length sufficient to enable a user's wrists to spread apart from one another their full span without said umbilical preventing such movement.

9. The training device of claim 4 wherein said spring loaded spool is situated on said strap supported by the dominant hand of a user.

10. The training device of claim 4 wherein said umbilical is paid out by said tension device in the direction toward the fingertips of a user.

11. The training device of claim 4 wherein said wristbands comprise straps capable of looping about a user's wrists and secured thereto by hook and loop fasteners.

* * * * *